US008384543B2

(12) United States Patent
Tatsumi et al.

(10) Patent No.: US 8,384,543 B2
(45) Date of Patent: Feb. 26, 2013

(54) SECURITY SYSTEM

(75) Inventors: Ichido Tatsumi, Chiyoda-ku (JP); Keiichi Matsui, Chiyoda-ku (JP); Yasuhiro Noma, Chiyoda-ku (JP); Akira Saitoh, Chiyoda-ku (JP); Hirofumi Inubushi, Chiyoda-ku (JP)

(73) Assignee: S-Cube Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 13/469,164

(22) Filed: May 11, 2012

(65) Prior Publication Data

US 2012/0218109 A1 Aug. 30, 2012

Related U.S. Application Data

(63) Continuation of application No. PCT/JP2010/005681, filed on Sep. 17, 2010.

(51) Int. Cl.
*G08B 13/14* (2006.01)

(52) U.S. Cl. ..... 340/568.8; 340/571; 340/572.1; 340/572.8; 340/872.9

(58) Field of Classification Search ..... 340/568.8
See application file for complete search history.

(56) References Cited

U.S. PATENT DOCUMENTS 5,910,768 A * 6/1999 Ott ..... 340/568.2
6,972,682 B2 * 12/2005 Lareau et al. ..... 340/568.1

FOREIGN PATENT DOCUMENTS

JP 2000-082185 A 3/2000
JP 2000-182159 A 6/2000
JP 2005-222179 A 8/2005
JP 2010-044593 A 2/2010

OTHER PUBLICATIONS

International Search Report (PCT/ISA/210) issued on Dec. 21, 2010, by the Japanese Patent Office as the International Searching Authority for International Application No. PCT/JP2010/005681.
Written Opinion (PCT/ISA/237) issued on Dec. 21, 2010, by the Japanese Patent Office as the International Searching Authority for International Application No. PCT/JP2010/005681.

* cited by examiner

*Primary Examiner* — George Bugg
*Assistant Examiner* — Anthony D Afrifa-Kyei
(74) *Attorney, Agent, or Firm* — Buchanan Ingersoll & Rooney PC

(57) ABSTRACT

A security system includes a sensor attached to a merchandise item, a slave unit attached to a merchandise rack and connected to one or a plurality of sensors via a wire, and a master unit that monitors theft of the merchandise item by wirelessly receiving a signal using a first frequency band from one or a plurality of slave units.

8 Claims, 17 Drawing Sheets

FIG. 3A

| RECEIVING SIGNAL | | | TRANSMISSION SIGNAL | |
|---|---|---|---|---|
| SIGNAL NAME | SIGNAL FREQUENCY | TRANSMISSION SOURCE | SIGNAL NAME | SIGNAL FREQUENCY |
| RESET SIGNAL (SHOP ID + RESET SIGNAL) | 22kHz | REMOTE CONTROLLER | COMMUNICATION CHECK/ OPERATION SIGNAL (SHOP ID + SLAVE UNIT ID + CHECK SIGNAL) | 315MHz |
| SET SIGNAL (SET SIGNAL) | 22kHz | REMOTE CONTROLLER | ALARM SIGNAL (SHOP ID + SLAVE UNIT ID + ALARM SIGNAL) | 315MHz |
| SHOP ID SET SIGNAL (SHOP ID + SET SIGNAL) | 22kHz | REMOTE CONTROLLER | ALARM STOP SIGNAL (SHOP ID + SLAVE UNIT ID + ALARM STOP SIGNAL) | 315MHz |
| SLAVE UNIT ID INQUIRY SIGNAL (INQUIRY SIGNAL) | 22kHz | MASTER UNIT | SLAVE UNIT ID REGISTRATION SIGNAL (SHOP ID + SLAVE UNIT ID + REGISTRATION SIGNAL) | 315MHz |
| SLAVE UNIT SHOP ID MATCHING SIGNAL (SHOP ID + MATCHING SIGNAL) | 22kHz | MASTER UNIT | | |
| SLAVE UNIT ID REGISTRATION COMPLETION SIGNAL (SHOP ID + SLAVE UNIT ID + REGISTRATION COMPLETION SIGNAL) | 22kHz | MASTER UNIT | | |

FIG. 3B

| RECEIVING SIGNAL | | | TRANSMISSION SIGNAL | |
|---|---|---|---|---|
| SIGNAL NAME | SIGNAL FREQUENCY | TRANSMISSION SOURCE | SIGNAL NAME | SIGNAL FREQUENCY |
| SHOP ID SET SIGNAL (SHOP ID + SET SIGNAL) | 22kHz | REMOTE CONTROLLER | SLAVE UNIT ID INQUIRY SIGNAL (INQUIRY SIGNAL) | 22kHz |
| COMMUNICATION CHECK/ OPERATION SIGNAL (SHOP ID + SLAVE UNIT ID + CHECK SIGNAL) | 315MHz | SLAVE UNIT | SLAVE UNIT SHOP ID MATCHING SIGNAL (SHOP ID + MATCHING SIGNAL) | 22kHz |
| ALARM SIGNAL (SHOP ID + SLAVE UNIT ID + ALARM SIGNAL) | 315MHz | SLAVE UNIT | SLAVE UNIT ID REGISTRATION COMPLETION SIGNAL (SHOP ID + SLAVE UNIT ID + REGISTRATION COMPLETION SIGNAL) | 22kHz |
| ALARM STOP SIGNAL (SHOP ID + SLAVE UNIT ID + ALARM STOP SIGNAL) | 315MHz | SLAVE UNIT | | |
| SLAVE UNIT ID REGISTRATION SIGNAL (SHOP ID + SLAVE UNIT ID + REGISTRATION SIGNAL) | 315MHz | SLAVE UNIT | | |

66a

| SHOP ID | SLAVE UNIT ID | | | |
|---|---|---|---|---|
| | 1 | 2 | ··· | n |
| ST_100 | SL_01 | SL_02 | ··· | SL_0N |

SECURITY SYSTEM

BACKGROUND OF THE INVENTION

1. Field of the Invention

The present invention relates to a security system for monitoring theft of merchandise items placed on merchandise racks at a shop.

2. Description of the Related Art

A security system is known for monitoring theft of merchandise items for sale or display. In such a system, a sensor is attached to each merchandise item, and when detached, notifies a monitoring device of the detachment via a wire. In this case, the monitoring device gives an alarm in response to the notification from the sensor.

The monitoring device (master unit) and the sensor are generally connected by a wire. A plurality of (for example, 10) sensors are connected to one monitoring device. For this reason, for example, if the merchandise items are arranged at narrow intervals, as indicated by 14A of FIG. 14, the wiring is a nuisance. If the merchandise items are arranged at wide intervals, the wires may be short, as indicated by 14B of FIG. 14, and it may be impossible to use all sensors.

To solve this problem, a technique of eliminating the wiring is also known. PTL 1 discloses a technique of adhering a box incorporating an IC tag to each merchandise item and causing a monitoring station (master unit) incorporating a reader to always wirelessly communicate with the box (slave unit). In this technique, if no response to the polling from the monitoring station is returned from the box, the monitoring station detects the abnormality and sounds a buzzer.

CITATION LIST

Patent Literature

PTL1: Japanese Patent Laid-Open No. 2010-044593

SUMMARY OF THE INVENTION

Technical Problem

In the above-described arrangement of PTL1, communication is always performed between the monitoring station and the box. Hence, the box requires large power and receives power from a power supply. In this arrangement, since the power supply for supplying the power to the box needs to be ensured, the number of boxes to be used is limited, or the arrangement position of each merchandise item (box) is restricted.

The present invention has been made in consideration of the above-described problem, and provides a technique of eliminating the nuisance of wiring between a slave unit and a master unit while maintaining the convenience of a conventional arrangement (an arrangement in which a sensor and a master unit are connected by a wire).

Solution to Problem

In order to solve the above-described problem, according to an aspect of the present invention, there is provided a security system for monitoring theft of a merchandise item placed on a merchandise rack at a shop, comprising a sensor attached to the merchandise item, a slave unit attached to the merchandise rack and connected to one or a plurality of the sensors via a wire, and a master unit that monitors theft of the merchandise item by wirelessly receiving a signal using a first frequency band from one or a plurality of the slave units, the slave unit comprising detection unit configured to detect one of detachment of the sensor from the merchandise item, detachment of the slave unit from the merchandise rack, and detachment of the wire from the slave unit so as to detect the theft of the merchandise item, slave-unit-side transmission unit that wirelessly transmits a signal using the first frequency band, configured to transmit, to the master unit, an alarm signal that instructs to start an alarm operation when the detection unit has detected the theft of the merchandise item, and slave-unit-side receiving unit that wirelessly receives a signal using a second frequency band representing a band different from the first frequency band, configured to receive an instruction from a remote controller that wirelessly transmits various kinds of signals using the second frequency band, and the master unit comprising first master-unit-side receiving unit that wirelessly receives the signal using the first frequency band, configured to receive the alarm signal transmitted by the slave-unit-side transmission unit, second master-unit-side receiving unit that wirelessly receives the signal using the second frequency band, configured to receive the instruction from the remote controller, and master-unit-side alarm unit configured to start the alarm operation when the first master-unit-side receiving unit has received the alarm signal.

Advantageous Effects of Invention

According to the present invention, it is possible to eliminate the nuisance of wiring between a slave unit and a master unit while maintaining the convenience of a conventional arrangement.

Other features and advantages of the present invention will be apparent from the following descriptions taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 3A is a table showing examples of transmission/receiving signals of the slave unit 14 shown in FIG. 1;

FIG. 3B is a table showing examples of transmission/receiving signals of a master unit 10 shown in FIG. 1;

DESCRIPTION OF THE EMBODIMENTS

A security system according to an embodiment of the present invention will now be described in detail with reference to the accompanying drawings.

Figure 1:
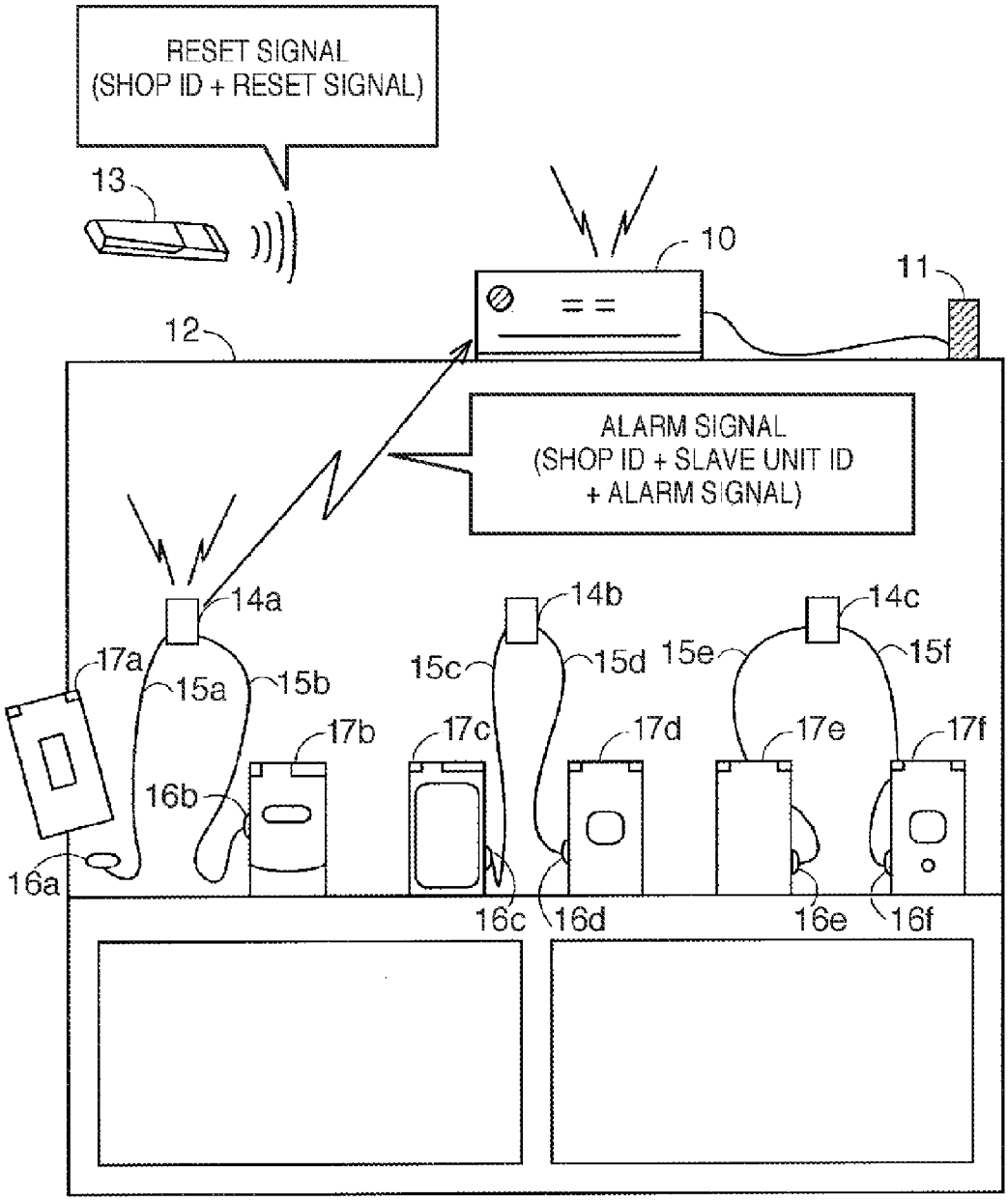
FIG. 1 is a view showing an example of a merchandise rack at a shop using a security system according to an embodiment of the present invention.

FIG. 1 is a view showing an example of a merchandise rack (merchandise display rack 12) at a shop using the security system. Note that the shop can be, for example, a large store such as a large consumer electronics retailer or a DIY store, a small shop such as a boutique or a variety store, or an exhibition hall. That is, the shop is not particularly limited as long as it lays out merchandise items (including exhibits) on merchandise racks.

The security system monitors theft of merchandise items placed on the merchandise racks at the shop. The shop is provided with the merchandise display rack 12 on which display merchandise items (cellular phones in this case) 17 (17*a* to 17*f*) are put on show. The plurality of display merchandise items 17 are arranged on the merchandise display rack 12 at a predetermined interval.

Sensors 16 (16*a* to 16*f*) are attached to the display merchandise items 17, respectively. The sensors 16 are connected to slave units 14 (14*a* to 14*c*) through cables 15 (15*a* to 15*f*). In this case, two sensors 16 are connected to one slave unit 14. Each sensor 16 is adhered to the merchandise item using, for example, a double-faced tape. The sensor 16 detects detachment from the display merchandise item 17 by, for example, a sensor lever provided on the surface (adhering surface) adhered to the merchandise item.

Each slave unit 14 is connected to a predetermined number of (two, in this case) sensors 16 through the cables 15 and configured to wirelessly communicate with a master unit (monitoring device) 10. The slave unit 14 has, on its side surfaces, a plurality of (two, in this case) connection jacks 21 to connect the terminals of the cables 15, as indicated by 2A of FIG. 2. The slave unit 14 is connected to the predetermined number of sensors 16 using the connection jacks 21.

The slave unit 14 is adhered to the merchandise display rack 12 using, for example, a double-faced tape. The adhering surface of the slave unit 14 is provided with a sensor lever 23, like the above-described sensor 16, as indicated by 2B of FIG. 2, so that the slave unit 14 can detect detachment from the merchandise display rack 12. The slave unit 14 incorporates a buzzer. A sound port 24 is provided in the cover portion of the slave unit 14, as indicated by 2B of FIG. 2. In addition, the slave unit 14 also includes an alarm LED (see 22 in 2A of FIG. 2).

The master unit 10 functions as a monitoring device that wirelessly communicates with one or a plurality of slave units 14 as the monitoring targets and monitors theft of the display merchandise items 17 via the slave units 14. The master unit 10 incorporates a buzzer, an alarm LED, and the like and is also connected to an alarm lamp 11. Upon receiving an alarm signal from the slave unit 14, the master unit 10 notifies the salespersons and the like of detachment of the sensor 16 from the display merchandise item 17, disconnection of the cable 15 from the slave unit 14, or detachment of the slave unit 14 from the merchandise display rack 12 using at least one of the buzzer, the alarm LED, and the alarm lamp 11.

A remote controller 13 transmits signals to the slave units 14 and the master unit 10 to remote-control these devices. For example, during the alarm operation of the slave unit 14 or the master unit 10 (sounding the buzzer or flickering the alarm LED or the like), a salesperson or the like operates the remote controller 13 to transmit a reset signal to the device and thus stop the alarm operation of the device. The remote controller 13 can also, for example, do various settings in the slave units 14 and the master unit 10.

When the sensor 16 is detached from the display merchandise item 17, the cable 15 is disconnected from the connection jack 21, or the slave unit 14 is detached from the merchandise display rack 12, the slave unit 14 accordingly sounds the internal buzzer to generate an audible alarm and turns on (more specifically, flickers) the internal alarm LED. At this time, the slave unit 14 also wirelessly transmits an alarm signal to the master unit 10. Then, the master unit 10 also sounds the buzzer and turns on (more specifically, flickers) the alarm LED and the alarm lamp 11. Note that FIG. 1 illustrates a state in which the sensor 16*a* is detached from the display merchandise item 17*a*, and the slave unit 14*a* accordingly transmits the alarm signal to the master unit 10. In this case, the slave unit 14*a*, the master unit 10, and the alarm lamp 11 perform the alarm operation.

Each slave unit 14 holds, in an internal memory (not shown), a shop ID that is identification information to identify the shop and a slave unit ID that is identification information to identify the slave unit. Note that the slave unit ID is generated in each slave unit 14. The shop ID and the slave unit IDs of the monitoring targets are registered in the master unit 10. When an alarm signal (a signal including a shop ID, a slave unit ID, and an alarm signal) is received from the slave unit 14, and shop IDs do not match or the slave unit ID does not belong to a monitoring target, the master unit 10 does not perform the alarm operation.

Examples of the signals exchanged between the master unit 10, the slave unit 14, and the remote controller 13 will be described here with reference to FIGS. 3A and 3B.

The signals received/transmitted by/from the slave unit 14 will be explained first using the list of FIG. 3A. As shown in FIG. 3A, the slave unit 14 receives a signal using a low-frequency signal (for example, 22 kHz) and transmits a signal using a high-frequency signal (for example, 315 MHz). Note that the low-frequency signal has a short coverage and reaches a distance of, for example, several cm to 1 m, whereas the high-frequency signal has a relatively wide coverage and reaches a distance up to, for example, several ten m.

The receiving signals the slave unit 14 receives from the remote controller 13 include a reset signal that instructs to cancel of the alarm operation, a set signal that instructs to do various operation settings, and a shop ID set signal that instructs to set the shop ID. The receiving signals the slave unit 14 receives from the master unit 10 include a slave unit ID inquiry signal to inquire about the slave unit ID, a slave unit shop ID matching signal representing that the slave unit IDs match, and a slave unit ID registration completion signal representing that slave unit ID registration is completed.

The transmission signals to be transmitted from the slave unit 14 include a communication check/operation signal to check, for example, the state of communication with the master unit 10, an alarm signal that instructs to start the alarm operation, an alarm stop signal that instructs to stop the alarm operation, and a slave unit ID registration signal that instructs to register the slave unit ID.

The signals received/transmitted by/from the master unit 10 will be explained next using the list of FIG. 3B. As shown in FIG. 3B, the master unit 10 transmits a signal using a low-frequency signal (for example, 22 kHz). In addition, the master unit 10 receives a signal from the remote controller 13 using a low-frequency signal (for example, 22 kHz) and a signal from the slave unit 14 using a high-frequency signal (for example, 315 MHz).

The receiving signals the master unit 10 receives from the remote controller 13 include a shop ID set signal that instructs to set the shop ID. The receiving signals the master unit 10 receives from the slave unit 14 include the above-described communication check/operation signal, alarm signal, alarm stop signal, and slave unit ID registration signal. The transmission signals to be transmitted from the master unit 10 include the above-described slave unit ID inquiry signal, slave unit shop ID matching signal, and slave unit ID registration completion signal.

As described above, the master unit 10, the slave unit 14, and the remote controller 13 exchange the signals using radio waves in different frequency bands depending on the operation contents (signal contents). More specifically, for example, the alarm signal and the like use the high-frequency signal capable of ensuring a wide area. The signals (shop ID set signal and the like) to be used to set and register various kinds of information use the low-frequency signal with a short coverage.

Note that the lists shown in FIGS. 3A and 3B describe information included in the signals. For example, the reset signal includes a shop ID and the reset signal. This also applies to the remaining signals.

Figure 4:
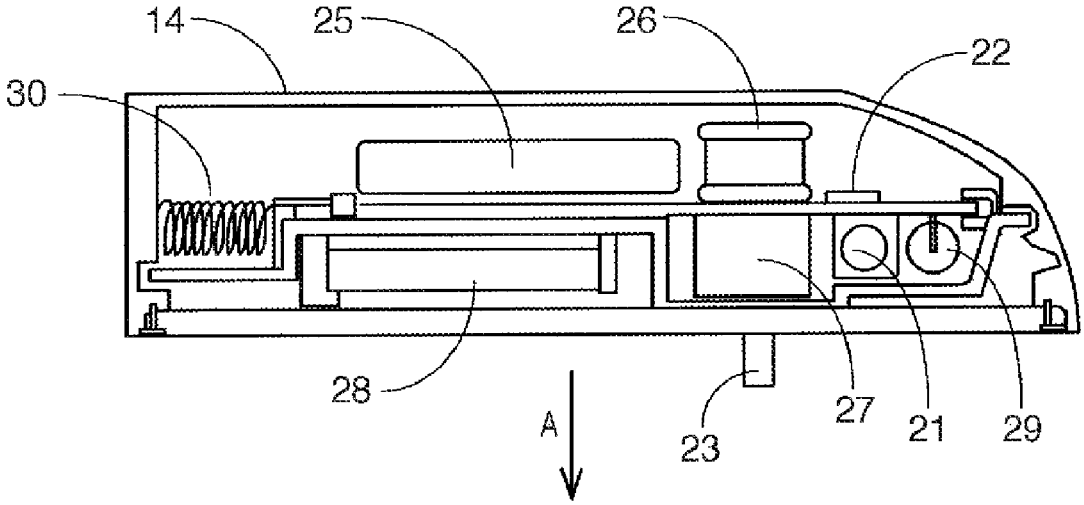
FIG. 4 is a sectional view showing an example of the internal hardware arrangement of the slave unit 14 shown in FIG. 1.

An example of the internal hardware arrangement of the slave unit 14 shown in FIG. 1 will be described next with reference to FIG. 4. Note that the same reference numerals as in FIG. 2 denote the same parts, and a description thereof will be omitted in some cases.

The slave unit 14 includes the connection jack 21, the alarm LED 22, a transmitting antenna 30, a buzzer 25, a receiving coil 26, a battery 28, a boosting coil 29, and a sensor unit 27 having the sensor lever 23.

The transmitting antenna 30 is used to transmit a signal to the master unit 10. The transmitting antenna 30 transmits a high-frequency signal. The receiving coil 26 is used to receive a signal from the remote controller 13 or the master unit 10. The receiving coil 26 receives a low-frequency signal.

The sensor unit 27 detects attachment of the slave unit 14 to the merchandise display rack 12 and detachment of the slave unit 14 from the merchandise display rack 12. To detect the attachment and detachment, the sensor unit 27 is provided with the sensor lever 23. In the normal state (when the slave unit 14 is not attached to the merchandise display rack 12), the sensor lever 23 receives a force from an elastic member (for example, spring) in the direction of an arrow A and therefore projects from the slave unit 14. When the slave unit 14 is attached to the merchandise display rack 12, the sensor lever 23 is depressed by the wall surface of the merchandise display rack 12 in the direction opposite to the direction of the arrow A and thus pushed into the slave unit 14.

If the slave unit 14 is detached from the merchandise display rack 12, the cable 15 is disconnected from the slave unit 14, or the sensor 16 is detached from the display merchandise item 17, the buzzer 25 generates an audible alarm. In synchronism with the audible alarm generation by the above-described buzzer 25, the alarm LED 22 flickers.

The boosting coil 29 is used to boost the voltage to be applied to the buzzer 25. The battery 28 supplies power to operate the respective components of the slave unit 14. The hardware arrangement of the slave unit 14 has been described above.

Figure 5:
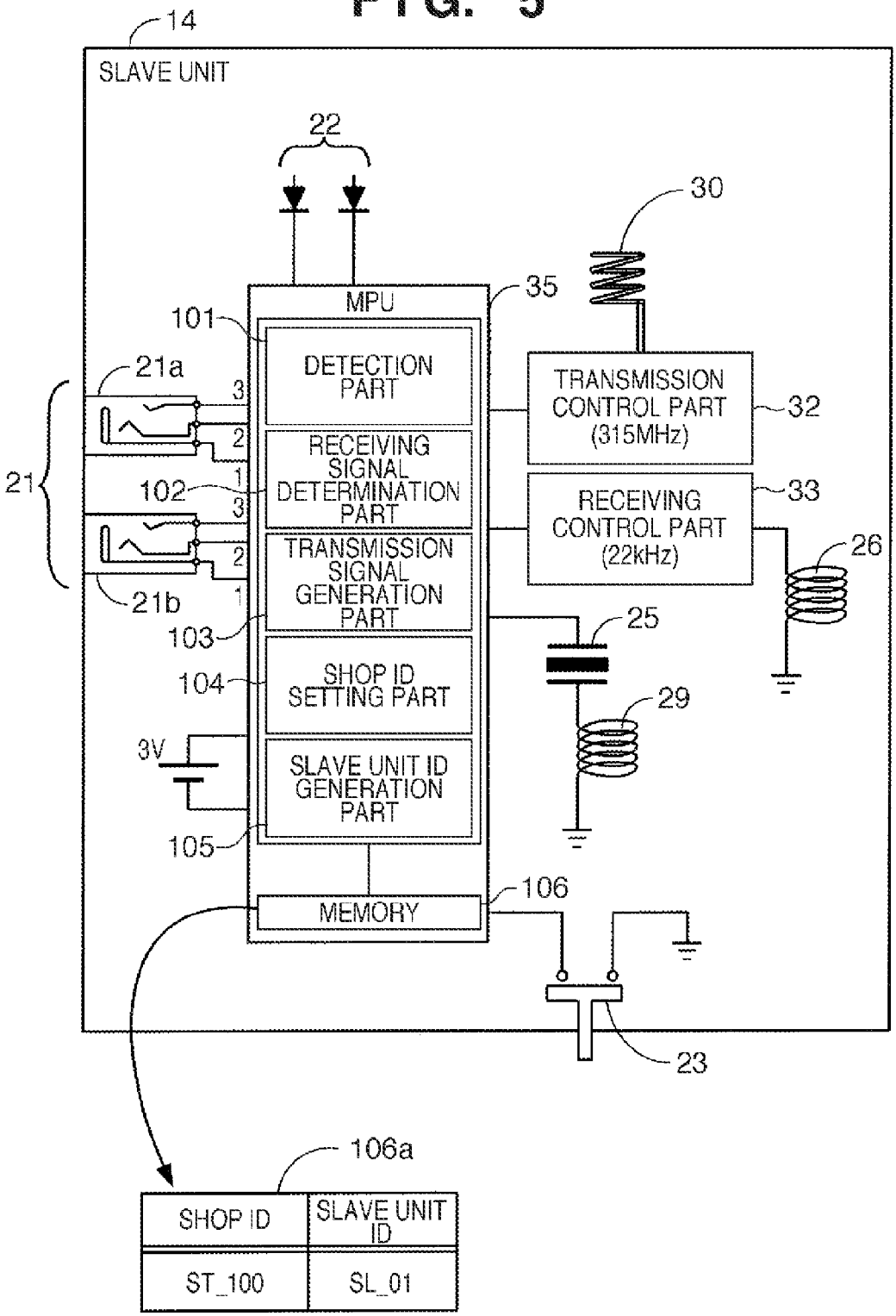
FIG. 5 is a view showing an example of the schematic arrangement of the slave unit 14 shown in FIG. 1.

An example of the schematic arrangement of the slave unit 14 shown in FIG. 1 will be described next with reference to FIG. 5. Note that the same reference numerals as in FIGS. 2 and 4 denote the same parts, and a description thereof will be omitted in some cases.

The slave unit 14 includes the connection jack 21, the alarm LED 22, the sensor lever 23, an MPU (Micro-Processing Unit) 35, the transmitting antenna 30, a transmission control part 32, the receiving coil 26, a receiving control part 33, the buzzer 25, and the boosting coil 29.

The connection jack 21 has an opening formed outward in the slave unit 14 to receive a terminal provided at an end of the cable 15. In this embodiment, a case in which two connection jacks 21 (21*a* and 21*b*) are provided will be exemplified. However, the present invention is not limited to this. Only one connection jack may suffice, or three or more connection jacks may be provided.

Figure 2:
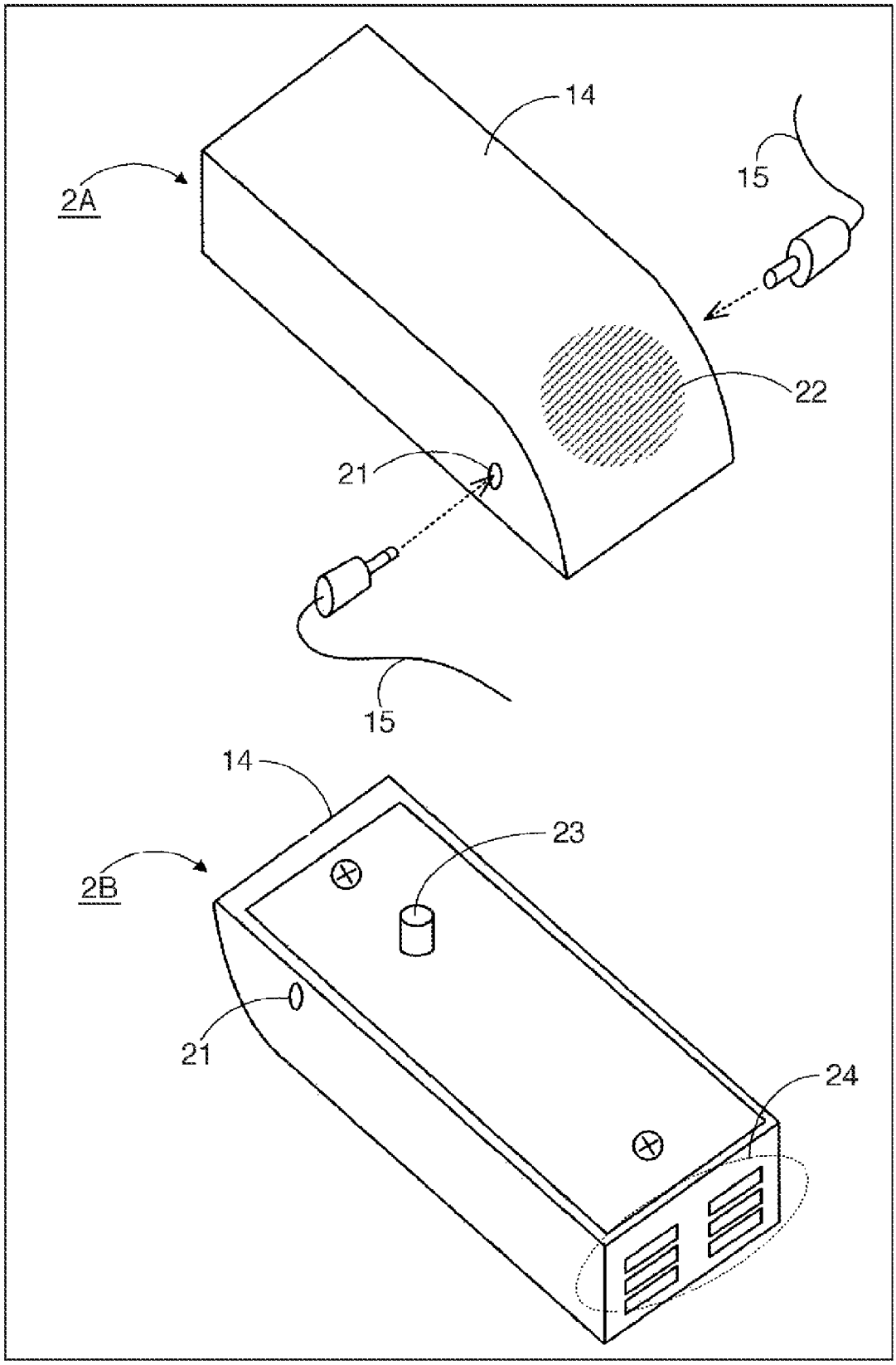
FIG. 2 is a perspective view showing an example of the outer appearance of a slave unit 14 shown in FIG. 1.

The sensor lever 23 detects attachment of the slave unit 14 to the merchandise display rack 12 and detachment of the slave unit 14 from the merchandise display rack 12, as described with reference to FIG. 2.

The transmission control part 32 controls signal transmission to the master unit 10 via the transmitting antenna 30. As described above, signal transmission from the slave unit 14 via the transmitting antenna 30 is done using a high-frequency signal (315 MHz in this case).

The receiving control part 33 controls signal reception from the remote controller 13 and the master unit 10 via the receiving coil 26. As described above, signal reception from the remote controller 13 and the master unit 10 via the receiving coil 26 is done using a low-frequency signal (22 kHz in this case).

The MPU 35 comprehensively controls the operation of the slave unit 14. The MPU 35 includes, as functional components, a detection part 101, a receiving signal determination part 102, a transmission signal generation part 103, a shop ID setting part 104, a slave unit ID generation part 105, and a memory 106.

The detection part 101 detects detachment of the slave unit 14 from the merchandise display rack 12, disconnection of the cable 15 from the slave unit 14, and detachment of the sensor 16 from the display merchandise item 17. Theft of the merchandise item is thus detected. How to detect detachment of the sensor 16 from the display merchandise item 17 will briefly be explained. The slave unit 14 (detection part 101) applies a predetermined voltage to the sensor 16 (resistance) through the cable 15 and monitors the value of the current flowing to the sensor 16. When a change in the current value is detected, the detection part 101 detects detachment of the sensor 16 from the display merchandise item 17.

The shop ID setting part 104 stores, in the memory 106, the shop ID included in the shop ID set signal sent from the remote controller 13. The slave unit ID generation part 105 generates the slave unit ID (identification information to identify each slave unit) and stores it in the memory 106. The memory 106 is implemented by, for example, an EEPROM (Electrically Erasable Programmable ROM) that is a nonvolatile memory capable of data write and read. As indicated by 106*a*, the memory 106 stores, for example, the shop ID set by the shop ID setting part 104, the slave unit ID generated by the slave unit ID generation part 105, and the like.

The receiving signal determination part 102 determines whether a signal sent from the remote controller 13 or the master unit 10 is addressed to the self device. This determination is done by, for example, comparing the shop ID and the slave unit ID stored in the memory 106 with the shop ID and the slave unit ID included in the receiving signal.

The transmission signal generation part 103 generates a transmission signal to be transmitted to the master unit 10. For example, when transmitting the alarm signal shown in FIG. 3A, the transmission signal generation part 103 generates a transmission signal including the alarm signal together with the shop ID and the slave unit ID stored in the memory 106.

Figure 6:
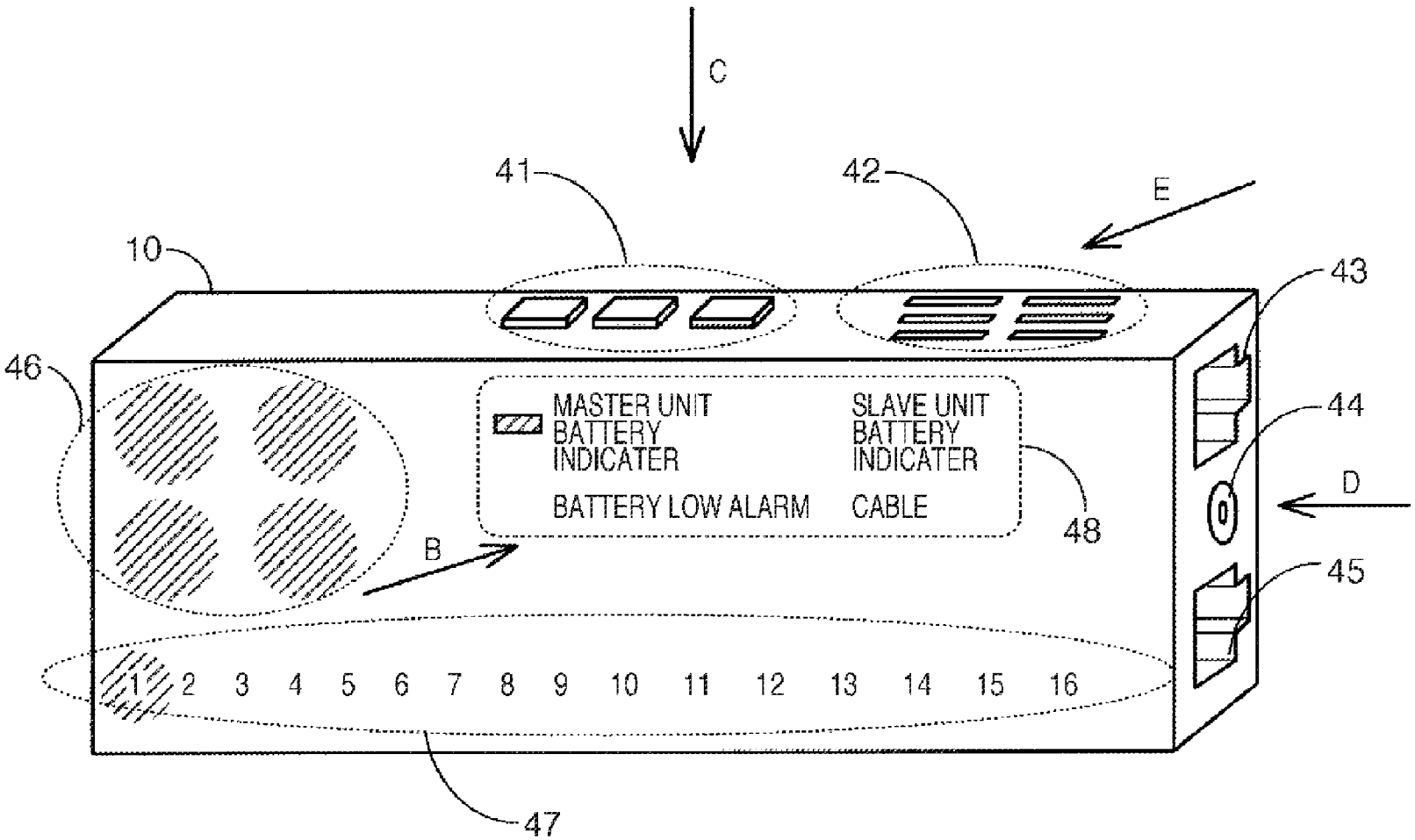
FIG. 6 is a perspective view showing an example of the outer appearance of the master unit 10 shown in FIG. 1.

An example of the outer appearance of the master unit 10 shown in FIG. 1 will be described next with reference to FIG. 6.

The upper surface (the surface of the master unit 10 viewed from the direction of an arrow C) of the master unit 10 is provided with various kinds of buttons 41 and a sound port 42. As the various kinds of buttons 41, for example, an UP button to increase a set value and the like, a DOWN button to decrease a set value and the like, and an enter button are provided.

The front surface (the surface of the master unit 10 viewed from the direction of an arrow B) of the master unit 10 is provided with alarm LEDs 46 and 47 and a status LED 48. The alarm LED 46 flickers upon receiving the alarm signal from the slave unit 14. A plurality of (16, in this case) alarm LEDs 47 are provided in correspondence with the plurality of slave units 14 as the monitoring targets. Out of the plurality of alarm LEDs 47 provided, the alarm LED 47 corresponding to the slave unit 14 (slave unit ID) of the transmission source of the alarm signal flickers (in this case, the alarm LED 47 corresponding to the slave unit with the slave unit ID "1" flickers). The status LED 48 is turned on to indicate a status concerning the master unit 10, connection to the slave units 14 to be monitored by the master unit 10, or the like.

A side surface (the surface of the master unit 10 viewed from the direction of an arrow D) of the master unit 10 is provided with an alarm lamp connection jack 43 to connect the alarm lamp 11, a power jack 44 to input power supplied from a power adapter, and a lead IN jack 45 to input the output of an external device into the master unit 10. Although not illustrated, the surface of the master unit 10 in the direction opposite to the direction of the arrow D is provided with a lead OUT jack to input the output from the master unit 10 to an external device, and the like.

Figure 7:
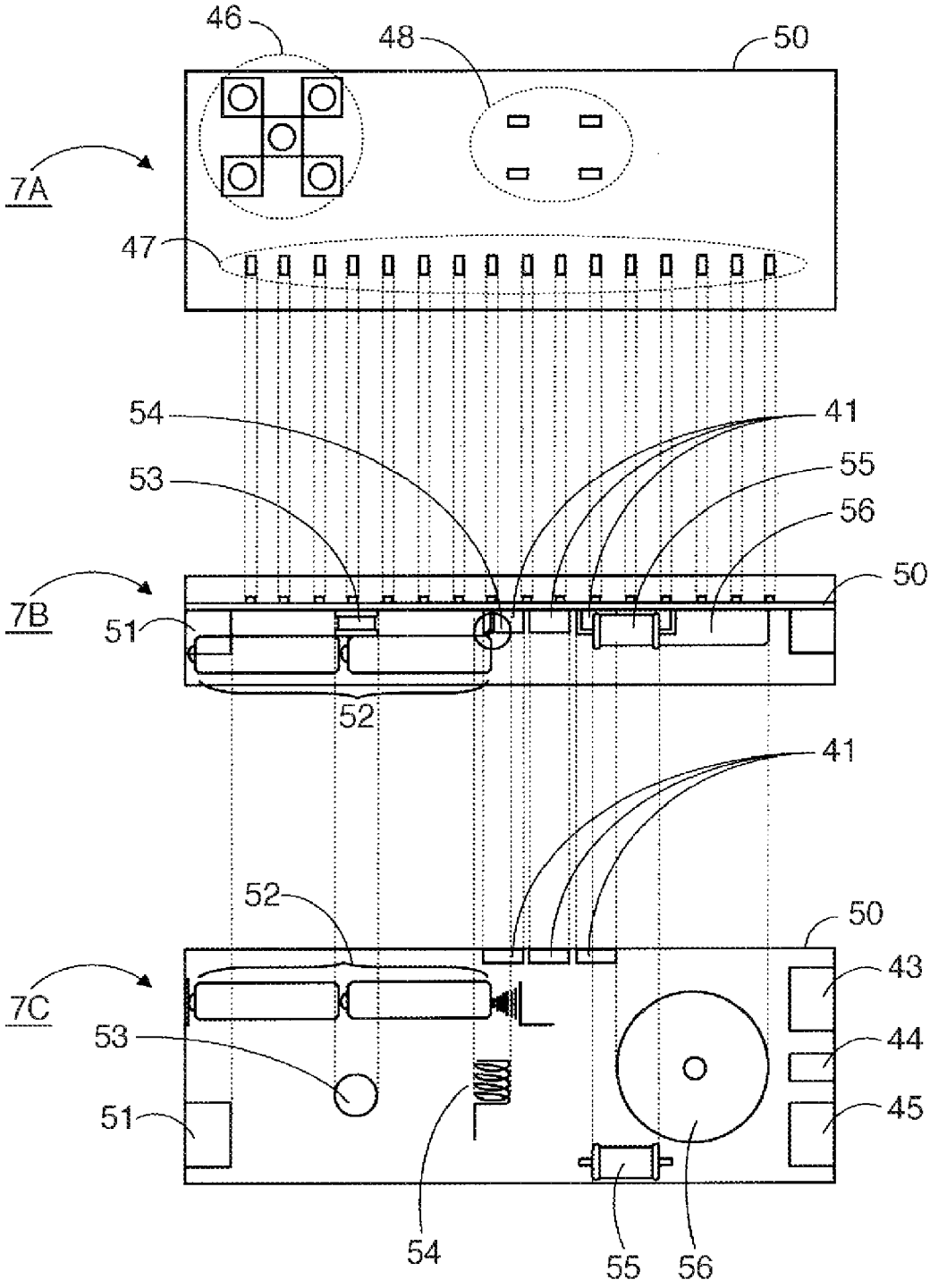
FIG. 7 is a view showing an example of the internal hardware arrangement of the master unit 10 shown in FIG. 1.

FIG. 7 is a view showing an example of the internal hardware arrangement of the master unit 10 shown in FIG. 1. In FIG. 7, 7A shows the internal hardware arrangement of the master unit 10 viewed from the direction of the arrow B in FIG. 6 (front surface), 7B shows the internal hardware arrangement of the master unit 10 viewed from the direction of the arrow C in FIG. 6 (upper surface), and 7C shows the internal hardware arrangement of the master unit 10 viewed from the direction of an arrow E in FIG. 6 (rear surface). Note that the same reference numerals as in FIG. 6 denote the same parts, and a description thereof will be omitted in some cases.

A control board 50 is provided in the master unit 10. As indicated by 7A, the front surface of the control board 50 is provided with the various kinds of LEDs (the alarm LEDs 46 and 47 and the status LED 48) described with reference to FIG. 6.

On the other hand, the surface on the opposite side is provided with a lead OUT jack 51, a receiving coil 53, a receiving antenna 54, a transmitting/boosting coil 55, a buzzer 56, a battery 52, and the various kinds of jacks (the alarm lamp connection jack 43, the power jack 44, and the lead IN jack 45) and various kinds of buttons 41 described with reference to FIG. 6, as indicated by 7B and 7C.

The receiving antenna 54 is used to receive a signal from the slave unit 14. The receiving antenna 54 receives a high-frequency signal, for example, the alarm signal from the slave unit 14. The receiving coil 53 is used to receive a signal from the remote controller 13. The receiving coil 53 receives a low-frequency signal, for example, various signals (various control instructions) from the remote controller 13.

The transmitting/boosting coil 55 transmits a low-frequency signal to the slave unit 14 or boosts the voltage to be applied to the buzzer 56. Note that the transmitting/boosting coil 55 is used to, for example, inquire of the slave unit 14 about the slave unit ID.

Upon receiving the alarm signal from the slave unit 14, the buzzer 56 generates an audible alarm. The battery 52 is used as an auxiliary power supply. The master unit 10 normally operates by receiving power from the power adapter via the power jack 44. When powered off because of disconnection of the power cable or the like, the master unit 10 operates by receiving power from the battery 52.

Figure 8:
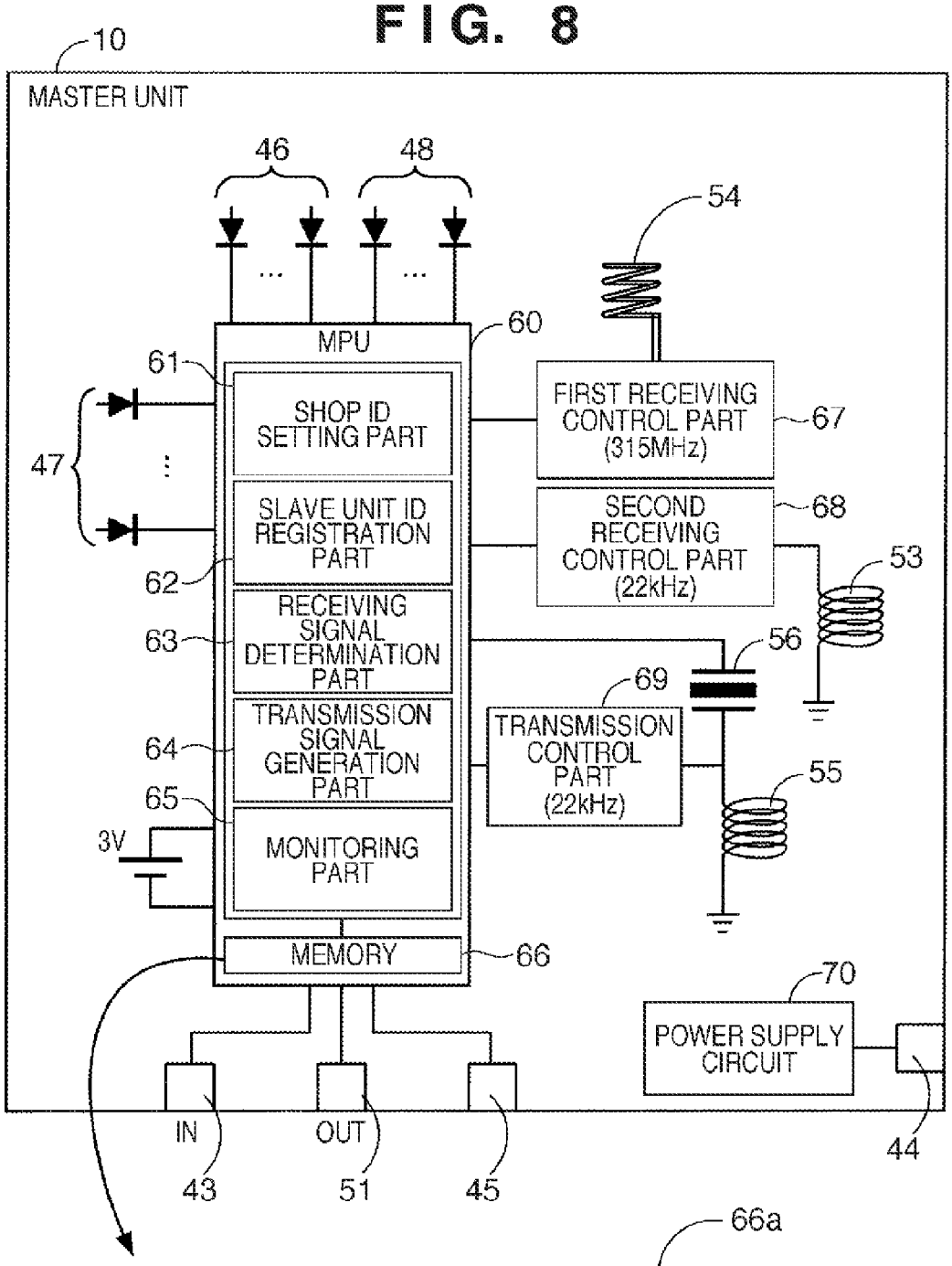
FIG. 8 is a view showing an example of the schematic arrangement of the master unit 10 shown in FIG. 1.

An example of the schematic arrangement of the master unit 10 shown in FIG. 1 will be described next with reference to FIG. 8. Note that the same reference numerals as in FIGS. 6 and 7 denote the same parts, and a description thereof will be omitted in some cases.

The master unit 10 includes the various LEDs 46 to 48, various jacks 43 to 45 and 51, an MPU 60, the receiving antenna 54, a first receiving control part 67, the receiving coil 53, a second receiving control part 68, the transmitting/boosting coil 55, a transmission control part 69, the buzzer 56, and a power supply circuit 70.

The first receiving control part 67 controls signal reception from the slave unit 14 via the receiving antenna 54. As described above, signal reception from the slave unit 14 via the receiving antenna 54 is done using a high-frequency signal (315 MHz in this case).

The second receiving control part 68 controls signal reception from the remote controller 13 via the receiving coil 53. As described above, signal reception from the remote controller 13 via the receiving coil 53 is done using a low-frequency signal (22 kHz in this case).

The transmission control part 69 controls signal transmission to the slave unit 14 via the transmitting/boosting coil 55. As described above, signal transmission from the master unit 10 via the transmitting/boosting coil 55 is done using a low-frequency signal (22 kHz in this case). The power supply circuit 70 supplies power received from the power adapter via the power jack 44 to the respective components of the master unit 10.

The MPU 60 comprehensively controls the operation of the master unit 10. The MPU 60 includes, as functional components, a shop ID setting part 61, a slave unit ID registration part 62, a receiving signal determination part 63, a transmission signal generation part 64, a monitoring part 65, and a memory 66.

The shop ID setting part 61 stores, in the memory 66, the shop ID included in the shop ID set signal sent from the remote controller 13. The slave unit ID registration part 62 registers, in the memory 66, the slave unit ID included in the slave unit ID registration signal sent from each slave unit 14 as the response to the slave unit ID inquiry signal.

The memory 66 is implemented by, for example, an EEPROM that is a nonvolatile memory capable of data write and read. As indicated by 66*a*, the memory 66 stores, for example, the shop ID set by the shop ID setting part 61, the slave unit IDs registered by the slave unit ID registration part 62, and the like. Note that the slave units 14 having the slave unit IDs registered in the memory 66 are the monitoring targets of the master unit 10.

The receiving signal determination part 63 determines whether a signal sent from the remote controller 13 or the slave unit 14 is addressed to the self device. This determination is done by, for example, comparing the shop ID and the slave unit IDs stored in the memory 66 with the shop ID and the slave unit ID included in the receiving signal.

The transmission signal generation part 64 generates a transmission signal to be transmitted to the slave unit 14. The monitoring part 65 performs all monitoring processes concerning theft of the display merchandise items 17.

Figure 9A:
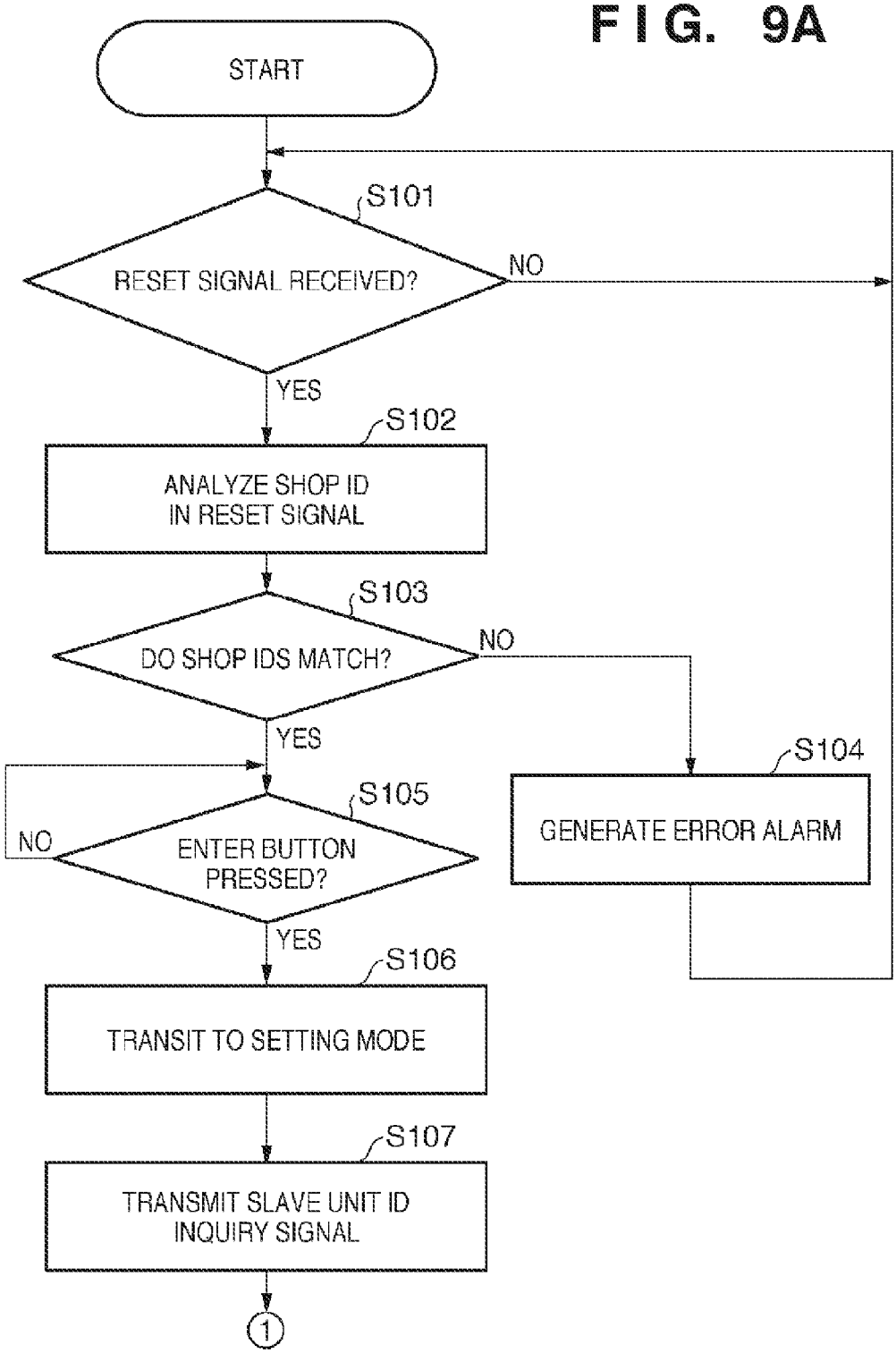
FIG. 9A is a flowchart illustrating an example of the procedure of processing of the slave unit 14 and the master unit 10 shown in FIG. 1.
Figure 9B:
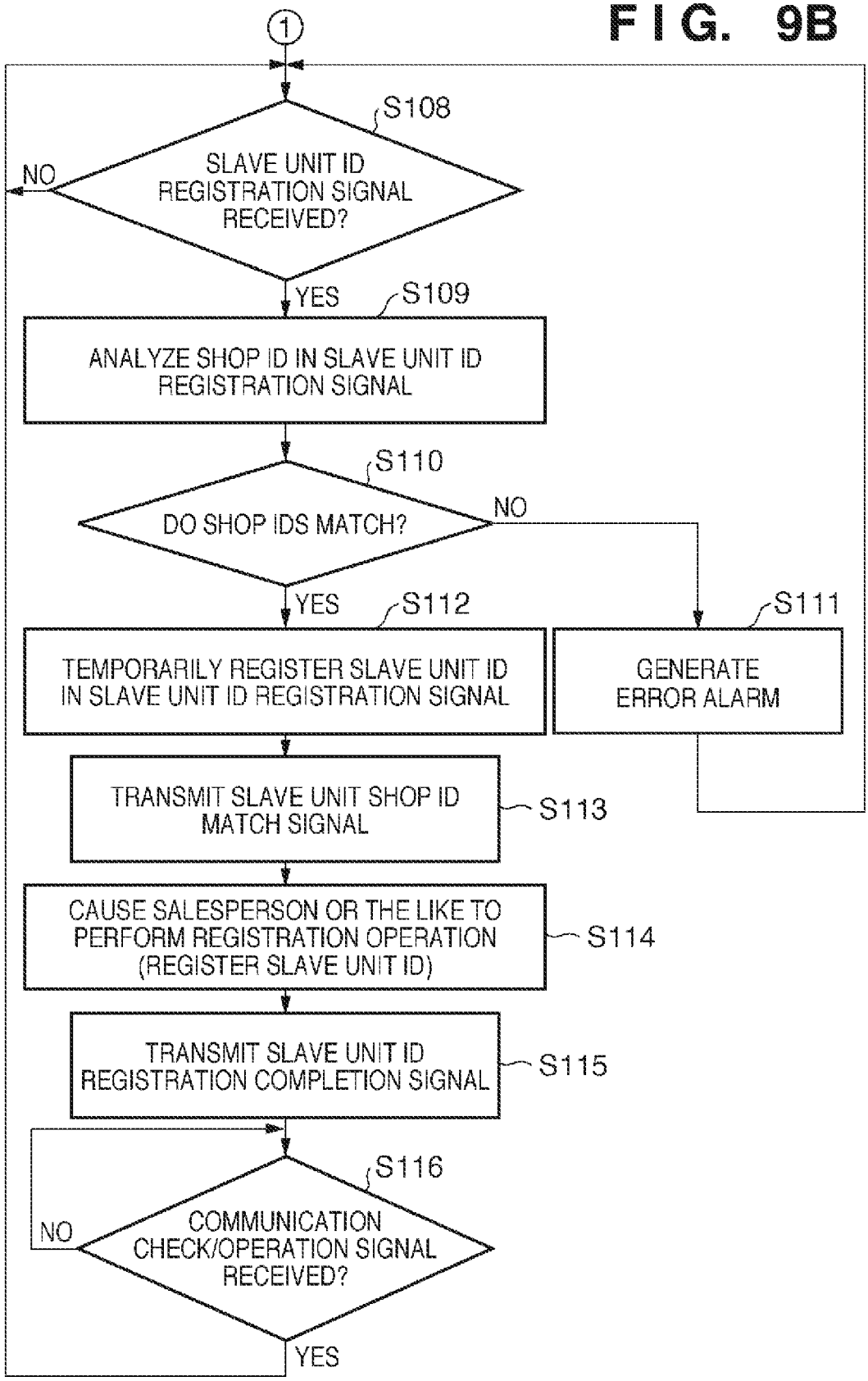
FIG. 9B is a flowchart illustrating an example of the procedure of processing of the slave unit 14 and the master unit 10 shown in FIG. 1.

An example of the operation of the slave unit 14 and the master unit 10 shown in FIG. 1 will be described next. An example of the procedure of processing of causing the master unit 10 to register the slave unit ID of the monitoring target slave unit 14 will be described first with reference to FIGS. 9A and 9B. The description will be made assuming that the shop ID has already been set in the slave unit 14 and the master unit 10.

To register the slave unit ID, a salesperson or the like operates the remote controller 13 to make the master unit 10 transit to a setting mode. When transiting to the setting mode, the remote controller 13 transmits the reset signal in accordance with the operation of the salesperson or the like. The transmission of the reset signal from the remote controller 13 is performed when the master unit 10 is not performing the alarm operation.

When the receiving coil 53 receives the reset signal (YES in step S101), the master unit 10 causes the receiving signal determination part 63 to analyze the reset signal and determine whether the reset signal is addressed to the self device (step S102). As described above, this determination is done by comparing the shop ID included in the reset signal with that stored in the memory 106.

If it is determined that the shop IDs do not match (NO in step S103) the master unit 10 generates an error alarm (step S104) and returns to the processing of step S101 again. On the other hand, if the shop IDs match (YES in step S103), the master unit 10 waits for press of the enter button (various buttons 41). When the salesperson or the like presses the enter button (YES in step S105), the master unit 10 transits to the setting mode (step S106). That is, in this embodiment, when the reset signal is received, and the enter button is pressed then, the master unit 10 transits to the setting mode. Note that if the master unit 10 transits to the setting mode in accordance with only the button operation (press of the enter button) on it, even an irregularity or tampering may cause the transit. To prevent this, the master unit of this embodiment is configured to go through the above-described procedure.

When the transit to the setting mode is completed, the master unit 10 transmits the slave unit ID inquiry signal (see FIG. 3B) via the transmitting/boosting coil 55 (step S107). Note that upon receiving the slave unit ID inquiry signal, the slave unit 14 transmits the slave unit ID registration signal via the transmitting antenna 30 as the response to register the slave unit ID of its own in the master unit 10. As shown in FIG. 3A, the slave unit ID registration signal includes the shop ID, the slave unit ID, and the registration number.

After transmitting the slave unit ID inquiry signal, the master unit 10 waits until the slave unit ID registration signal is received from the slave unit (NO in step S108). As shown in FIG. 3A, the slave unit ID registration signal includes the shop ID, the slave unit ID, and the registration number. Note that if the slave unit ID registration signal is not received even after the elapse of a predetermined time, the master unit 10 cancels the setting mode and ends the processing.

Upon receiving the slave unit ID registration signal via the receiving antenna 54 (YES in step S108), the master unit 10 causes the receiving signal determination part 63 to analyze the slave unit ID registration signal and determine whether the slave unit ID registration signal has been received from the monitoring target slave unit 14 (shop) (step S109). In this determination, the shop ID included in the slave unit ID registration signal is compared with that stored in the memory 66 (step S110).

If it is determined that the shop IDs do not match (NO in step S110), the master unit 10 generates an error alarm (step S111) and returns to the processing of step S108 again to wait for reception of the slave unit ID registration signal. On the other hand, if the shop IDs match (YES in step S110), the master unit 10 stores, in the memory 66, the slave unit ID included in the slave unit ID registration signal and temporarily registers the slave unit ID as the identification information of the monitoring target slave unit 14 (step S112).

When temporary registration of the slave unit ID is completed, the master unit 10 transmits the slave unit shop ID matching signal via the transmitting/boosting coil 55 (step S113). After that, the salesperson or the like performs a slave unit ID registration operation to the master unit 10. For example, an operation of registering the slave unit ID of the registration target at a specific storage position in the memory 66 is performed. If the number of registered slave unit IDs has reached the limit, an operation of canceling the slave unit registration may be performed. As a result of such an operation, for example, the slave unit ID temporarily registered in the processing of step S112 is registered as the identification information of the monitoring target slave unit 14 (step S114).

When the operation of the salesperson or the like ends, and the enter button or the like is pressed, the master unit 10 transmits the slave unit ID registration completion signal via the transmitting/boosting coil 55 (step S115). Upon receiving the slave unit ID registration completion signal, the slave unit 14 transmits the communication check/operation signal via the transmitting antenna 30 as the response. As shown in FIGS. 3A and 3B, the communication check/operation signal includes the shop ID, the slave unit ID, and the check signal.

Upon receiving the communication check/operation signal (step S116), the master unit 10 returns to the processing of step S108 again to wait for reception of the slave unit ID registration signal from another slave unit 14. Note that the setting mode is canceled by an operation of the salesperson or the like through the various buttons 41 or when a no-operation state has continued for a predetermined time.

Figure 10:
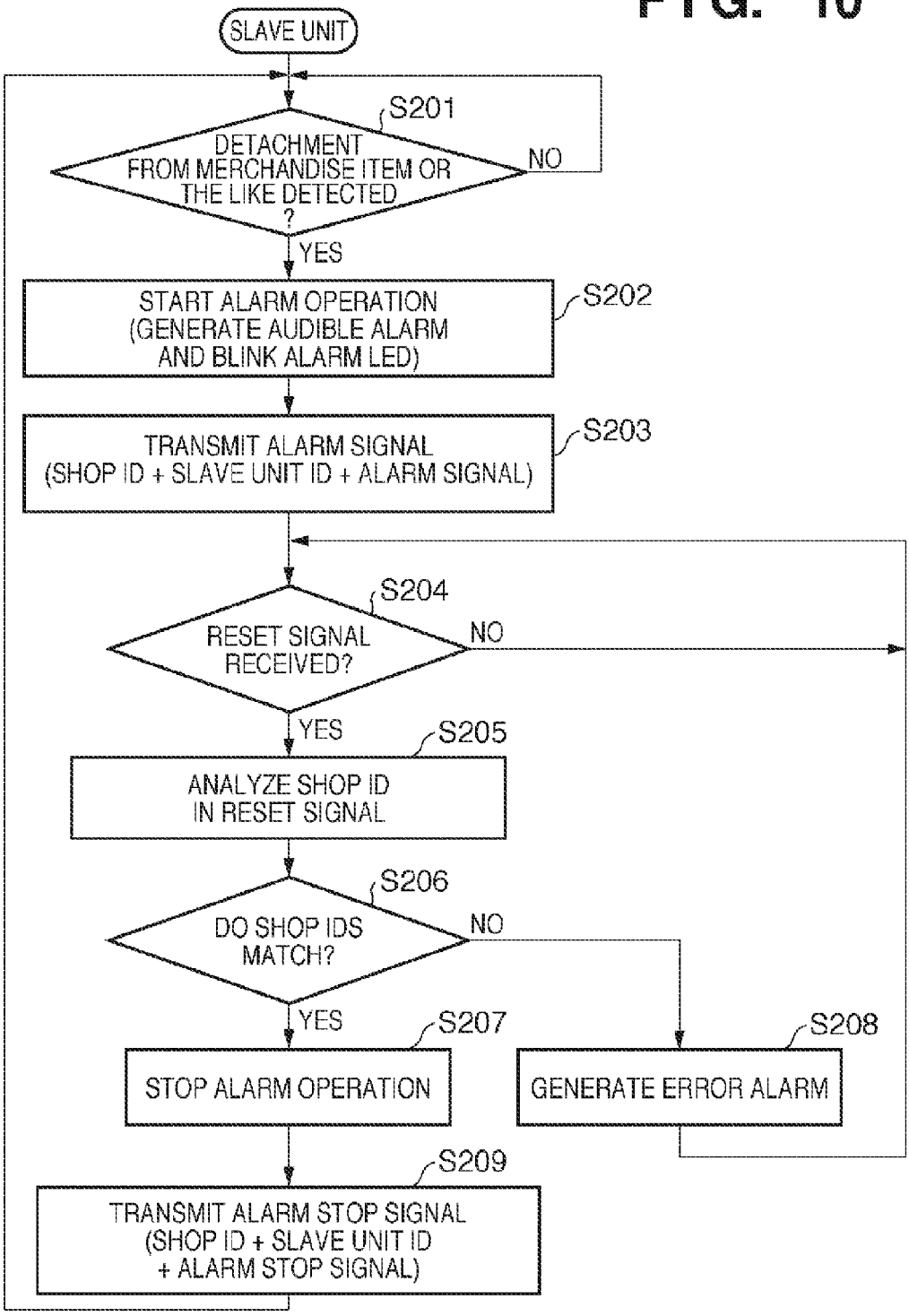
FIG. 10 is a flowchart illustrating an example of the procedure of processing of the slave unit 14 shown in FIG. 1.
Figure 11A:
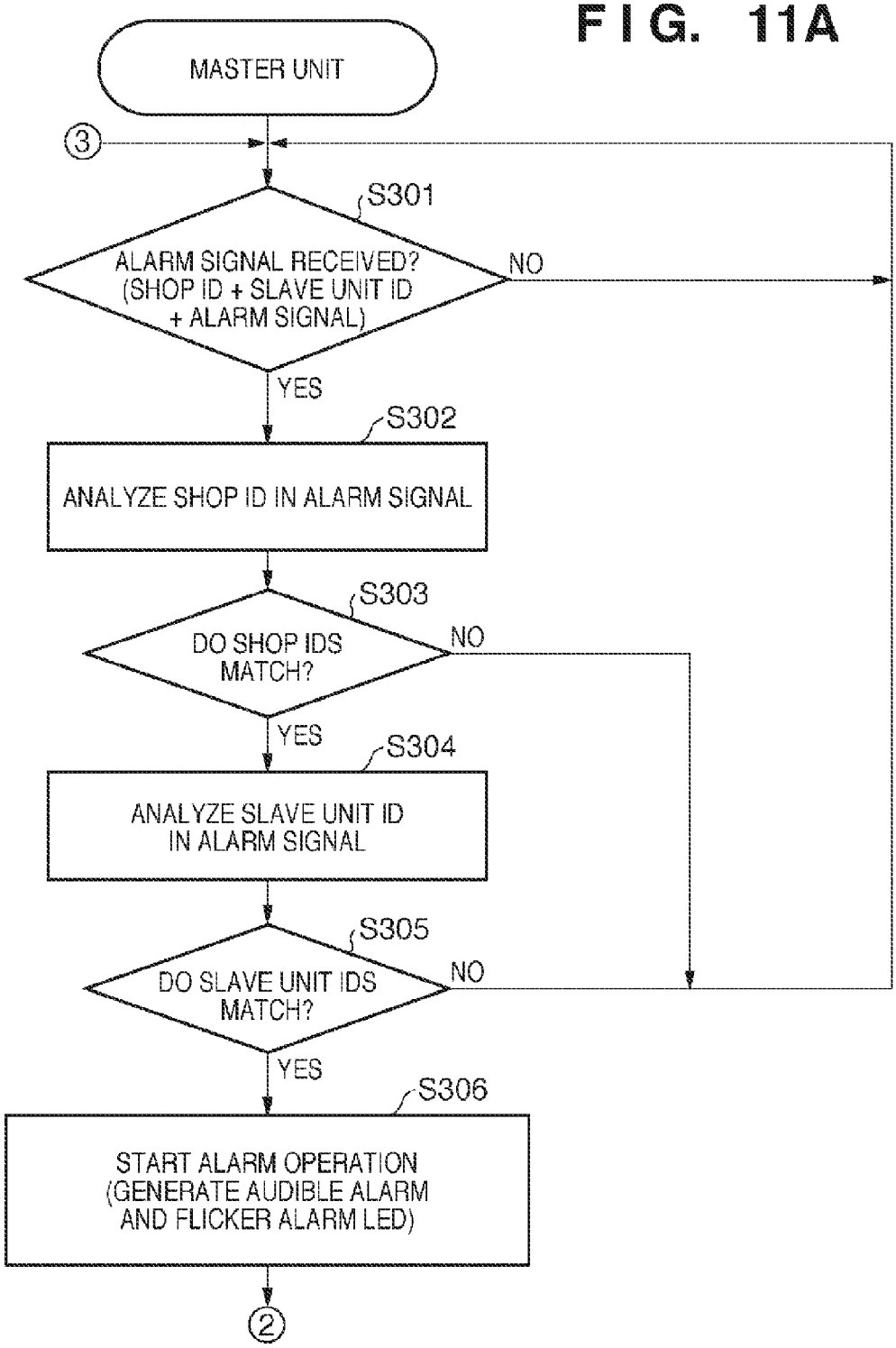
FIG. 11A is a flowchart illustrating an example of the procedure of processing of the master unit 10 shown in FIG. 1.
Figure 11B:
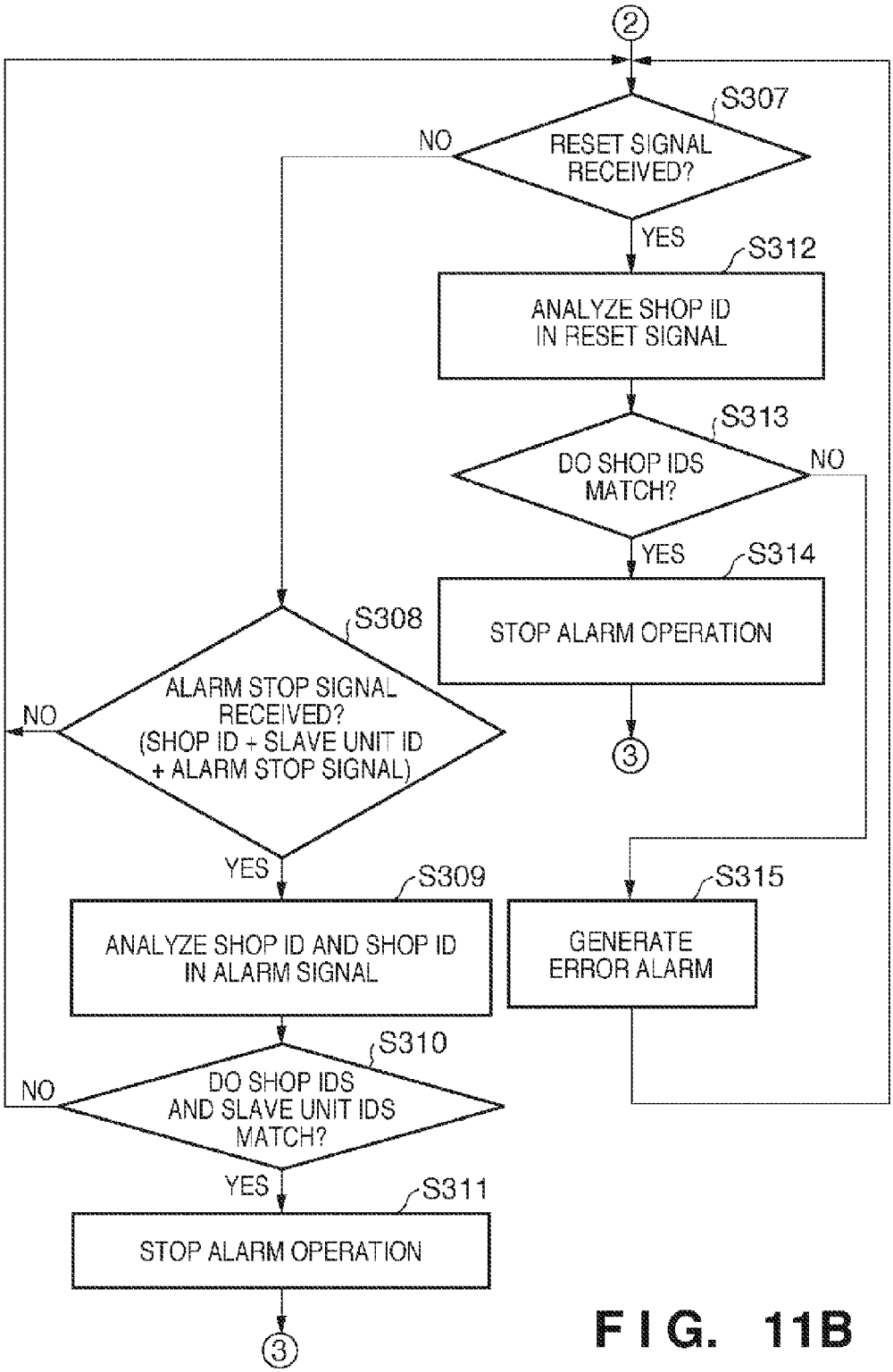
FIG. 11B is a flowchart illustrating an example of the procedure of processing of the master unit 10 shown in FIG. 1.

The procedure of processing concerning the security operation will be described next with reference to FIGS. 10, 11A, and 11B. The description will be made assuming that generation and setting of the shop ID and the slave unit IDs have already been done in the slave unit 14 and the master unit 10.

An example of the procedure of processing of the slave unit 14 will be explained first with reference to FIG. 10.

The slave unit 14 monitors theft of the display merchandise item 17 through the sensor 16 (NO in step S201). When the slave unit 14 is detached from the merchandise display rack 12, the cable 15 is disconnected from the slave unit 14, or the sensor 16 is detached from the display merchandise item 17 (YES in step S201), the slave unit 14 starts the alarm operation (step S202). That is, the slave unit 14 sounds the buzzer 25 and flickers the alarm LED 22. At this time, the slave unit 14 causes the transmission signal generation part 103 to generate the alarm signal and transmit it to the master unit 10 via the transmitting antenna 30 (step S203).

When transmission of the alarm signal is completed, the slave unit 14 waits for reception of the reset signal from the remote controller 13 (NO in step S204). Upon receiving the reset signal via the receiving coil 26 (YES in step S204), the slave unit 14 causes the receiving signal determination part 102 to analyze the reset signal and determine whether the reset signal is addressed to the self device (step S205). As described above, this determination is done by comparing the shop ID included in the reset signal with that stored in the memory 106.

If it is determined that the shop IDs do not match (NO in step S206), the slave unit 14 generates an error alarm (step S208) and returns to the processing of step S204 again to waits for reception of the reset signal. On the other hand, if the shop IDs match (YES in step S206), the slave unit 14 stops the alarm operation (step S207) and causes the transmission signal generation part 103 to generate the alarm stop signal and transmit it to the master unit 10 via the transmitting antenna 30 (step S209). Note that the alarm stop signal is transmitted to stop the alarm operation that has started in the master unit 10 in response to the alarm signal transmission in step S203.

An example of the procedure of processing of the master unit 10 will be explained next with reference to FIGS. 11A and 11B.

The master unit 10 monitors theft of the display merchandise item through the sensor 16 and the slave unit 14 (NO in step S301). Upon receiving the alarm signal from the slave unit 14 via the receiving antenna 54 (YES in step S301), the master unit 10 causes the receiving signal determination part 63 to analyze the alarm signal and determine whether the alarm signal has been received from the monitoring target slave unit 14 (shop). In this determination, the shop ID included in the alarm signal is first compared with that stored in the memory 66 (step S302).

If it is determined that the shop IDs do not match (NO in step S303), the master unit 10 returns to the processing of step S301 again to wait for reception of the alarm signal. On the other hand, if the shop IDs match (YES in step S303), the master unit 10 causes the receiving signal determination part 63 to determine whether the alarm signal has been received from the monitoring target slave unit 14 by comparing the slave unit ID included in the alarm signal with the slave unit IDs stored in the memory 66.

If it is determined that the slave unit IDs do not match (NO in step S305), the master unit 10 returns to the processing of step S301 again because the slave unit 14 of the alarm signal transmission source is not a monitoring target slave unit. On the other hand, if the slave unit IDs match (YES in step S305), the master unit 10 starts the alarm operation (step S306). That is, the master unit 10 sounds the buzzer 56 and flickers the alarm LEDs 46 and 48. At this time, the master unit 10 flickers the alarm lamp 11, too.

After that, the master unit 10 waits until the reset signal from the remote controller 13 is received via the receiving coil 53, or the alarm stop signal from the slave unit 14 is received via the receiving antenna 54 (NO in step S307 and NO in step S308).

Upon receiving the reset signal via the receiving coil 53 (YES in step S307), the master unit 10 causes the receiving signal determination part 63 to analyze the reset signal and determine whether the reset signal is addressed to the self device (step S312). As described above, this determination is done by comparing the shop ID included in the reset signal with that stored in the memory 66.

If it is determined that the shop IDs do not match (NO in step S313), the master unit 10 generates an error alarm (step S315) and returns to the processing of step S307 again to wait for reception of the reset signal or the alarm stop signal. On the other hand if the shop IDs match (YES in step S313) the master unit 10 stops the alarm operation (step S314) and returns to the processing of step S301 again.

Upon receiving the alarm stop signal via the receiving antenna 54 during the wait for signal reception in steps S307 and S308 (YES in step S308), the master unit 10 causes the receiving signal determination part 63 to analyze the alarm stop signal and determine whether the alarm stop signal has been received from the monitoring target slave unit 14 (step S309). This determination is done by comparing the shop ID and the slave unit ID included in the alarm stop signal with the shop ID and the slave unit IDs stored in the memory 66.

If it is determined that the shop IDs and the slave unit IDs do not match (NO in step S310), the master unit 10 returns to the processing of step S307 again because the slave unit 14 of the alarm stop signal transmission source is not a monitoring target slave unit. On the other hand, if the shop IDs and the slave unit IDs match (YES in step S310) the master unit 10 stops the alarm operation (step S311) and returns to the processing of step S301 again.

As described above, according to this embodiment, communication between the slave unit 14 and the master unit 10 is performed wirelessly. It is therefore possible to eliminate the nuisance of wiring between the slave unit and the master unit. In addition, even when the communication between the devices is done wirelessly, the number of slave units is not limited, and the arrangement position of each slave unit is not restricted. This allows to ensure the same convenience as in the conventional arrangement using wiring.

Additionally, according to this embodiment, signals are exchanged using radio waves in different frequency bands depending on the operation contents (signal contents). That is, a high-frequency signal is used for a signal to be transmitted in a relatively long range, and a low-frequency signal is used for a signal to be transmitted in a relatively short range. Since confidential information is not transmitted farther than necessary, a high security level can be maintained. In addition, a signal that needs to reach a long distance can appropriately serve its purpose.

An example of the typical embodiment of the present invention has been described above. However, the present invention is not limited to the embodiment described and illustrated above and can appropriately be modified without departing from the scope of the present invention.

Figure 12:
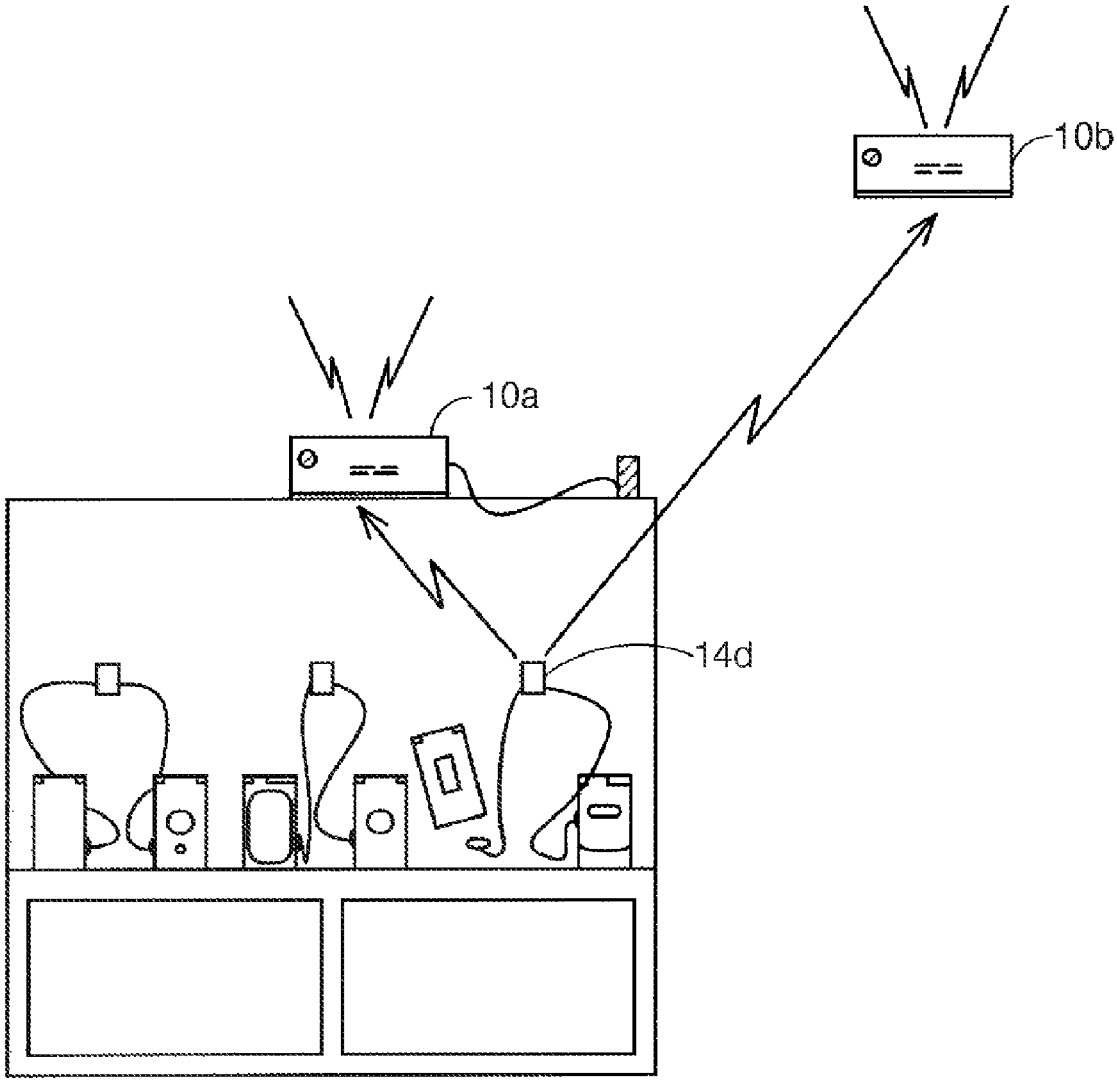
FIG. 12 is a view showing a modification of the embodiment.

For example, as shown in FIG. 12, when the display merchandise item 17 is detached from the sensor 16, the slave unit 14 may transmit the alarm signal to a plurality of (two, in this case) master units 10*a* and 10*b*, and the plurality of master units 10*a* and 10*b* may perform the alarm operation. In this case, the slave unit ID of the slave unit 14*d* is registered in the memory 66 of each of the master units 10*a* and 10*b* in advance. In this embodiment, since the alarm signal uses the high-frequency signal, the alarm signal can be transmitted to the master unit 10*b* at a relatively long distance. For this reason, the master unit 10*b* may be placed in, for example, the office of the shop.

Figure 13:
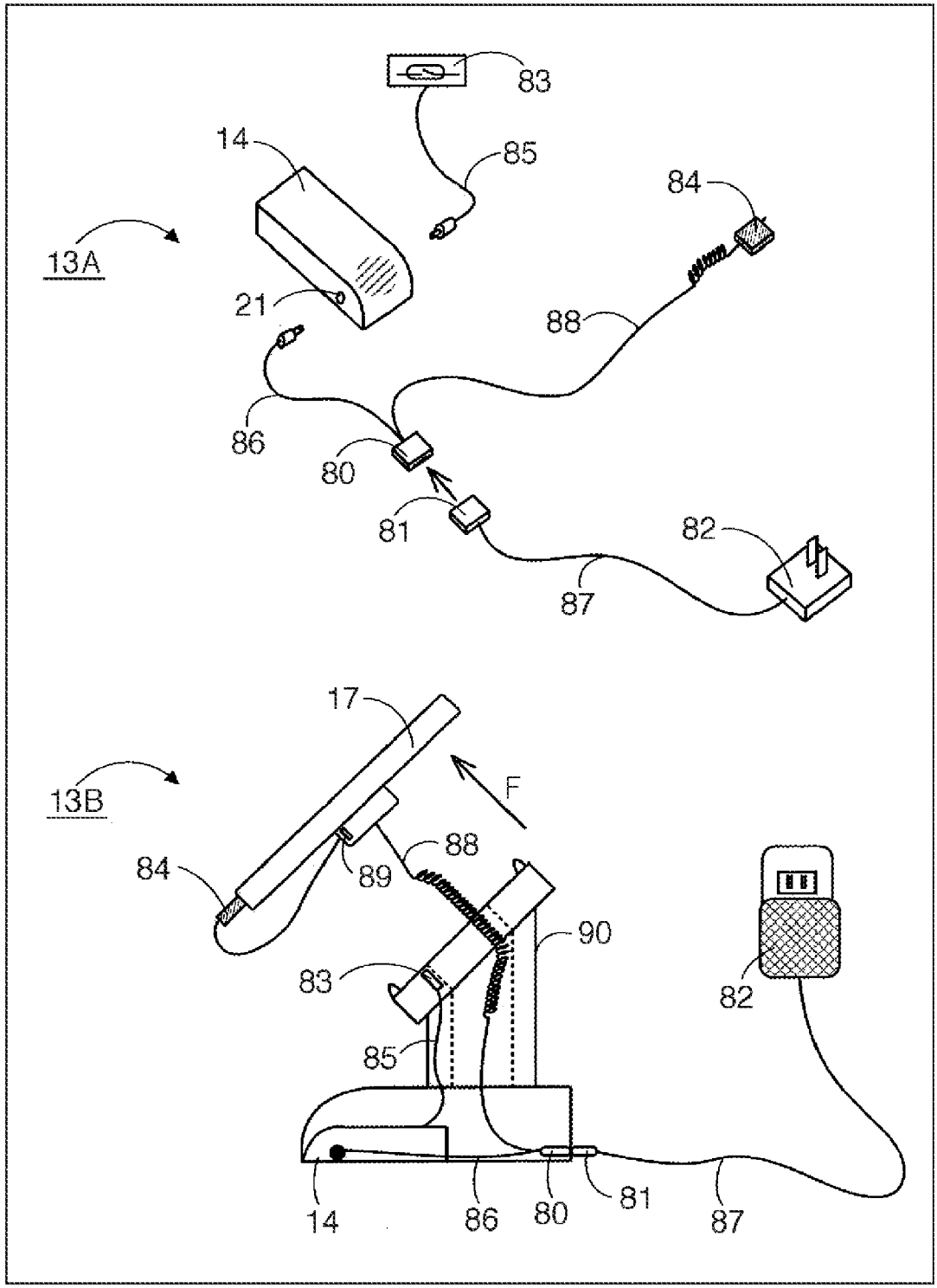
FIG. 13 is a view showing another modification of the embodiment.
Figure 14:
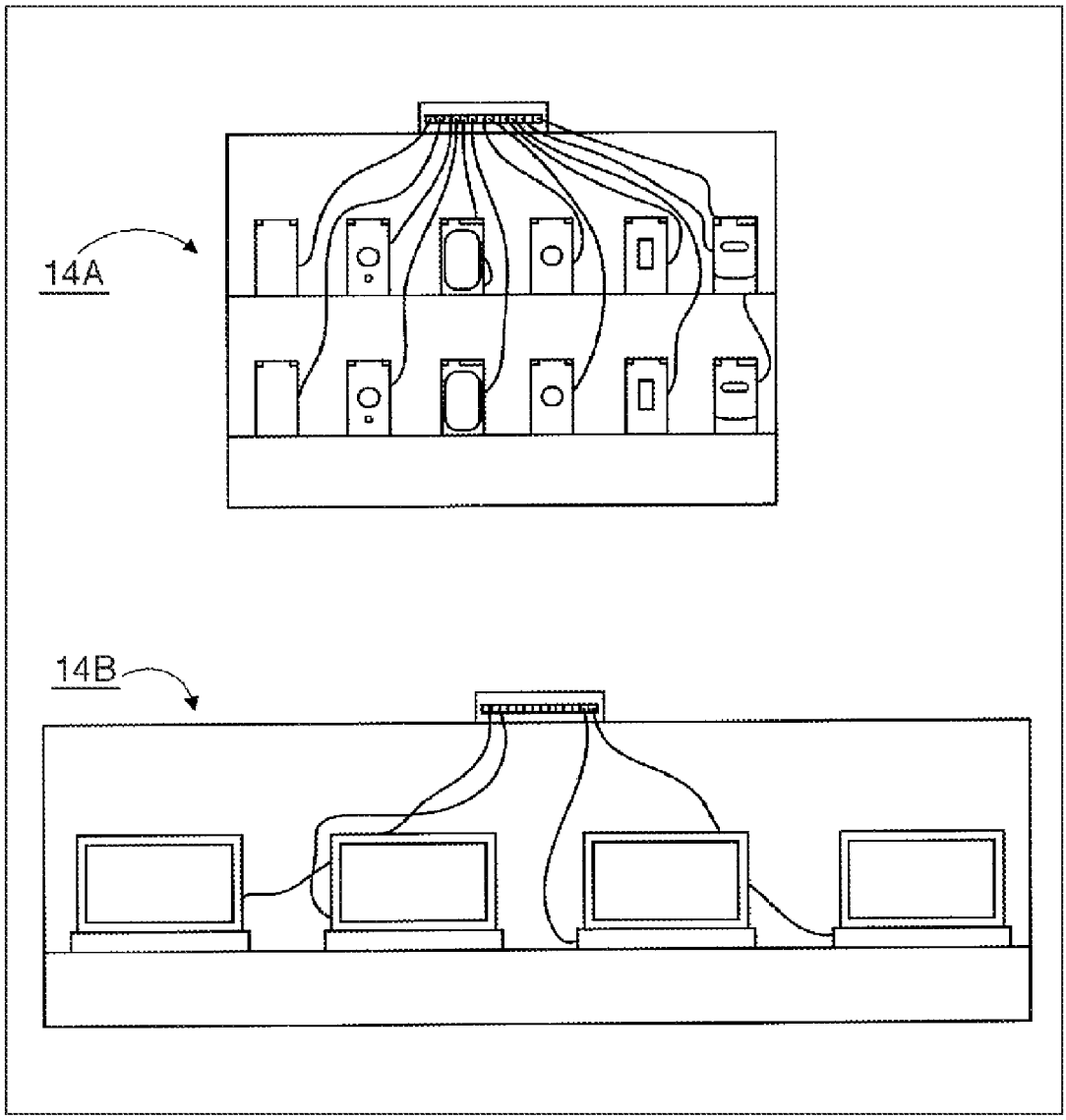
FIG. 14 is a view showing an example of a related art.

As indicated by 13B of FIG. 13, the slave unit 14 may be mounted inside a holder 90. The holder 90 detachably supports the display merchandise item 17 and incorporates the slave unit 14. As indicated by 13A and 13B of FIG. 13, one connection jack 21 of the slave unit 14 is connected to the terminal of a cable 85 to which a lead switch 83 is connected. The other connection jack 21 is connected to the terminals of cables 86 and 88 to which a slave unit 84 capable of supplying power from a portable power adapter 82 to the cellular phone 17 is connected. A magnet 89 is adhered to the rear surface (the surface of the cellular phone 17 viewed from the direction of an arrow F) of the cellular phone. Every time the adhered magnet 89 is separated from the lead switch 83 provided in the holder 90, the information is sent to the slave unit 14 through the cable 85. The slave unit 14 thus transmits a count signal when, for example, a customer picks up the cellular phone 17 (or any other information device that receives the supplied power).

In the above embodiment, a case in which the slave unit 14 itself incorporates the buzzer and the alarm LED has been described. However, the slave unit 14 need not always incorporate such a component.

In the above embodiment, an example has been explained in which the shop ID is included in various signals and the memories 106 and 66 of the slave unit 14 and the master unit 10. However, the shop ID need not always be included in the signals and the like. In addition, the display merchandise items 17 may be monitored without using the master unit 10. That is, the merchandise items may be monitored using only the sensors 16 and the slave units 14.

In the above-described embodiment, the low-frequency signal has a frequency of 22 kHz, and the high-frequency signal has a frequency of 315 MHz. However, the numerical values are merely examples and are not limited to those. Since usable frequency bands change depending on the country, the frequency bands to be used as the high-frequency signal and the low-frequency signal are determined based on the usable bands. In, for example, China, a band of 314 to 316 MHz is used as the band of the high-frequency signal. In Europe, a band of 868 MHz is used. In USA, a band of 433 MHz is used.

The present invention is not limited to the above embodiments and various changes and modifications can be made within the spirit and scope of the present invention. Therefore, to apprise the public of the scope of the present invention, the following claims are made.

What is claimed is:

1. A security system for monitoring theft of a merchandise item placed on a merchandise rack at a shop, the security system comprising:

a sensor attached to the merchandise item;

a slave unit attached to the merchandise rack and connected to one or a plurality of said sensors via a wire; and a master unit that monitors theft of the merchandise item by wirelessly receiving a signal using a first frequency band from one or a plurality of said slave units, said slave unit comprising:

detection unit configured to detect one of detachment of said sensor from the merchandise item, detachment of said slave unit from the merchandise rack, and detachment of the wire from said slave unit so as to detect the theft of the merchandise item;

slave-unit-side transmission unit that wirelessly transmits a signal using the first frequency band, configured to transmit, to said master unit, an alarm signal that instructs to start an alarm operation when said detection unit has detected the theft of the merchandise item; and slave-unit-side receiving unit that wirelessly receives a signal using a second frequency band representing a band different from the first frequency band, configured to receive an instruction from a remote controller that wirelessly transmits various kinds of signals using the second frequency band, and said master unit comprising:

first master-unit-side receiving unit that wirelessly receives the signal using the first frequency band, configured to receive the alarm signal transmitted by said slave-unit-side transmission unit;

second master-unit-side receiving unit that wirelessly receives the signal using the second frequency band, configured to receive the instruction from the remote controller; and master-unit-side alarm unit configured to start the alarm operation when said first master-unit-side receiving unit has received the alarm signal.

2. The security system according to claim 1, wherein said slave unit further comprises a slave-unit-side memory configured to hold a slave unit ID to be used to identify said slave unit, said slave-unit-side transmission unit transmits the alarm signal including the slave unit ID held in said slave-unit-side memory, said master unit further comprises:

a master-unit-side memory configured to hold a slave unit ID of a slave unit as a monitoring target; and determination unit configured to determine whether the slave unit ID included in the alarm signal received by said first master-unit-side receiving unit matches the slave unit ID held in said master-unit-side memory, and said master-unit-side alarm unit starts the alarm operation when said determination unit has determined that the slave unit IDs match.

3. The security system according to claim 2, wherein said slave unit further comprises slave unit ID generation unit configured to generate the slave unit ID and store the slave unit ID in said slave-unit-side memory, said slave-unit-side transmission unit transmits a slave unit ID registration signal including the generated slave unit ID, and said master unit transits to a setting mode when a user operates a predetermined button provided on said master unit, and when said first master-unit-side receiving unit has received the slave unit ID registration signal after the transit to the setting mode, registers the slave unit ID included in the slave unit ID registration signal in said master-unit-side memory as the slave unit ID of the slave unit as the monitoring target.

4. The security system according to claim 1, wherein said slave unit further comprises slave-unit-side alarm unit configured to start the alarm operation when said detection unit has detected the theft of the merchandise item, when said slave-unit-side receiving unit has received, from the remote controller, a reset signal that instructs to stop the alarm operation, said slave-unit-side transmission unit transmits an alarm stop signal that instructs to stop the alarm operation in said master unit, said slave-unit-side alarm unit stops the alarm operation when said slave-unit-side receiving unit has received the reset signal from the remote controller, and said master-unit-side alarm unit stops the alarm operation when said first master-unit-side receiving unit has received the alarm stop signal.

5. The security system according to claim 4, wherein the alarm operation by said master-unit-side alarm unit and said slave-unit-side alarm unit is performed by at least one of generating an audible alarm and turning on an alarm LED.

6. The security system according to claim 1, wherein said master unit further comprises master-unit-side transmission unit that wirelessly transmits a signal using the second frequency band, configured to transmit a signal concerning a setting operation for said slave unit, and said slave unit causes said slave-unit-side receiving unit to receive the signal concerning the setting operation transmitted by said master-unit-side transmission unit.

7. The security system according to claim 1, wherein the signal using the first frequency band is a high-frequency signal, and the signal using the second frequency band is a low-frequency signal having a frequency lower than that of the signal using the first frequency band.

8. The security system according to claim 1, the security system further comprising a holder placed on the merchandise rack to detachably hold the merchandise item, wherein said slave unit is mounted inside said holder.

* * * * *